US010030428B2

(12) United States Patent
Muñoz Pelayo

(10) Patent No.: US 10,030,428 B2
(45) Date of Patent: Jul. 24, 2018

(54) DAMPING SYSTEM FOR CLOSETS WITH SLIDING DOORS

(71) Applicant: ADINOR S.L., Valladolid (ES)

(72) Inventor: Ricardo Muñoz Pelayo, Valladolid (ES)

(73) Assignee: Adinor S.L. (ES)

( * ) Notice: Subject to any disclaimer, the term of this patent is extended or adjusted under 35 U.S.C. 154(b) by 0 days.

(21) Appl. No.: 15/374,243

(22) Filed: Dec. 9, 2016

(65) Prior Publication Data

US 2017/0260793 A1 Sep. 14, 2017

(51) Int. Cl.
*E05F 3/00* (2006.01)
*E05F 5/00* (2017.01)

(52) U.S. Cl.
CPC ..... *E05F 5/003* (2013.01); *E05Y 2201/212* (2013.01); *E05Y 2600/51* (2013.01); *E05Y 2600/56* (2013.01); *E05Y 2900/132* (2013.01)

(58) Field of Classification Search
CPC ..... E05F 5/003; E05F 5/05; E05F 1/08; E05F 1/1091; E05F 1/16; E05F 3/00; E05F 3/02; E05F 3/04; E05F 3/18; E05F 3/227; E05F 3/22; E05F 3/10; E05F 3/108; E05F 3/224; E05F 5/02; E05Y 2800/24; E05Y 2800/21; E05Y 2201/64; E05Y 2201/644; E05Y 2201/264; E05Y 2201/41; E05Y 2201/412; E05Y 2201/47; E05Y 2201/21; E05Y 2201/488; E05Y 2900/132; E05Y 2900/142; E05Y 2900/14; E05Y 2201/232; E05Y 2201/426; E05Y 2201/638; E05Y 2201/688; E05Y 2800/11; E05Y 2201/212;

(Continued)

(56) References Cited

U.S. PATENT DOCUMENTS

2008/0284299 A1* 11/2008 Chen ..... A47B 88/467 312/332
2011/0023370 A1* 2/2011 Zimmer ..... E05F 1/16 49/360

(Continued)

FOREIGN PATENT DOCUMENTS

EP 2 980 344 2/2016
ES 106 7224 5/2008

(Continued)

OTHER PUBLICATIONS

Spanish Search Report, dated Nov. 19, 2015

*Primary Examiner* — Chuck Mah
(74) *Attorney, Agent, or Firm* — Emerson Thomson Bennett, LLC; Daniel A. Thomson

(57) ABSTRACT

The present invention relates to a damping system for closets with sliding doors (2) comprising: a damping device (1) and an actuating element (3), wherein the damping device (1) can be fitted in the upper guide (2*a*) of a door (2) through deformation of flanges (7) of respective supporting parts (5, 6) of said damping device (1) to allow the damping device (1) to be secured in the closet itself and to allow said damping device (1) to slide driven by the actuating element (3) during the relative movement between both; or the element actuating element (3) can be fitted in the upper guide (2*a*) of the door (2) through deformation of flanges (3*c*) of said actuating element (3), which allows it to be secured and to slide driven by the damping device (1) during the relative movement between both.

14 Claims, 3 Drawing Sheets

(58) Field of Classification Search
CPC . E05Y 2600/51; E05Y 2600/56; Y10T 16/27; Y10T 16/56; Y10T 16/61; Y10T 16/593; Y10T 16/276; Y10T 16/281; Y10T 16/379; E05D 15/00; E05D 15/06; E05D 15/12; A47B 88/047; A47B 88/12; A47B 88/14; A47B 2210/0091
See application file for complete search history.

(56) References Cited

U.S. PATENT DOCUMENTS

2011/0067313 A1* 3/2011 Walhorn ..... E05F 1/16 49/360
2011/0167588 A1* 7/2011 Chang ..... E05F 5/003 16/71
2011/0271482 A1* 11/2011 Nezu ..... E05F 1/16 16/49
2012/0062088 A1* 3/2012 Chen ..... A47B 88/463 312/319.1
2012/0269470 A1* 10/2012 Zimmer ..... A47B 88/047 384/20
2013/0076219 A1* 3/2013 Lam ..... A47B 88/14 312/319.1
2013/0122157 A1* 5/2013 Dogan ..... B65D 85/8043 426/115
2013/0182978 A1* 7/2013 Huang ..... A47B 88/467 384/21
2014/0109343 A1* 4/2014 Chang ..... E05F 5/003 16/49

FOREIGN PATENT DOCUMENTS

ES 107 2238 6/2010
JP 2008223456 A * 9/2008
TW M 493 587 1/2015
WO 2014 169 771 10/2014

* cited by examiner

DAMPING SYSTEM FOR CLOSETS WITH SLIDING DOORS

TECHNICAL FIELD OF THE INVENTION

The present invention relates to a damping system for closets with sliding doors and to the associated mounting and installation method, which closets are comprised within the home and interior furniture sector.

The main purpose of the damping system for closets with sliding doors object of the invention is to provide a tool capable of reducing the closing speed of a sliding door of a closet, such that it prevents users from getting their fingers caught and possible impacts of the door itself with the side frame of the closet, which may cause premature wear of both the side frame and said sliding door; furthermore, the system requires using easy-to-install physical entities that can be perfectly installed in any type of sliding door regardless of the width of its upper and lower guide, in addition to being competitive with respect to the damping systems existing today.

BACKGROUND OF THE INVENTION

By way of introduction, different types of damping system for closets with sliding doors that are usually based on a damping device and an actuating element for actuating the damping device are known. More specifically, the damping device is fixed by means of screws or similar fixing elements to the upper guide of the frame of the sliding door, such that the manufacturer indicates in the assembly manual the distance at which said damping device must be placed with respect to the side of the sliding door which closes the closet.

Similarly, the actuating element is also fixed by means of screws or similar fixing elements, but in this case it is fixed on the back of the door, or to the larger inner surface of said door, such that the manufacturer again indicates in the assembly manual the distance at which said actuating element must be placed with respect to the side of the sliding door which closes the closet.

For clarification, the relative position between both elements means that they work together to reduce the closing speed of the sliding door and to thereby prolong its service life as well as increase the perceived quality of the entire closet. Firstly, the operation is based on the placement of the actuating element, which is located in the sliding door, and when the door is about to close, it is the actuating element itself which, through a projection of said actuating element, comes into contact with part of the damping device screwed to the guide of the frame of the door and activates the damping device, causing the door itself to slow down until reaching the end of the damper's path. It is a simple and practical system that is very effective in prolonging the service life of the entire closet by reducing the impacts of the doors with respect to the frame.

However, as indicated previously when installing the assembly formed by the damping device and the actuating element, the user must take into account the distances indicated by the manufacturer, such that in the event that the measurement is not taken correctly or there are distractions when taking measurements, the user must unscrew either the damping device or the actuating element until it is located in the ideal position which allows the sliding door to slowly and softly close with respect to the frame thereof. It must be pointed out that having to reposition the damping device and/or actuating element means leaving behind visible drill holes that spoil the appearance of the closet, reducing the quality perceived by the user, in addition to the significant time loss that occurs due to failure to achieve a perfect fit the first time.

Therefore, in view of the main drawback relating to the need to have specific fixing distances between the damping device, the actuating element and the actual frame of the door, there is a need for a new damping system for sliding doors that is capable of simplifying both the design of its components and the associated mounting and installation method, preventing the need to obtain predetermined and normally confusing dimensions which may cause problems for the user since the actuating element and/or the damping device must be unscrewed one or more times in order to get the damped braking of the sliding door to work correctly, paying particular attention to the fact that a customer, after knowing the time required for installing the damping device and the actuating element, may reject it for that drawback alone.

DESCRIPTION OF THE INVENTION

The present invention relates to a damping system for closets with sliding doors comprising: a damping device and an actuating element comprising at least one projection configured for coming into contact with the damping device, as well as reducing the closing speed thereof; and wherein the damping device itself additionally comprises, in a first alternative embodiment:

- an oblong body in turn having a damping element, defining a longitudinal direction of the oblong body parallel to the guide of the door of the closet; and
- a pair of respective supporting parts coupled to the ends of said oblong body, such that each supporting part has a pair of flanges located respectively on the sides of each supporting part, and in the direction parallel to the longitudinal direction of the oblong body, and said flanges being configured to allow the damping device to be secured in the closet itself and to allow said damping device to slide driven by the actuating element during the relative movement between both.

In this sense, two preferred alternative embodiments are highlighted, in the first one, the actuating element is coupled to the door and the damping device is fitted in the guide of the door as a result of the pressure of the flanges on the side walls of the guide. Alternatively, in the second embodiment the actuating element is coupled to the guide of the door as a result of the pressure of the flanges on the side walls of the guide, and the damping device is coupled in the upper portion of the door, there being two solutions to choose from depending on the type of sliding door, frame and closet to be used. In this sense, the second option describes how the actuating element comprises a pair of flanges located respectively on the sides of said actuating element, which flanges are configured to allow the actuating element to be secured in the guide of the door the closet itself and to allow said actuating element to slide driven by the damping device during the relative movement between both.

In relation to the configuration of the main entities forming the damping device, said damping device has in the first alternative embodiment two supporting parts wherein there is formed in each of them a pair of flanges intended for allowing the damping device to be secured in the guide of the frame of the sliding door, such that said solution allows the user to not have to position the damping device or the actuating element at a specific distance, because the damping device can move along the guide as it is not screwed to it, but secured by means of the pressure exerted by the flanges of each supporting part with respect to the guide of the frame of the sliding door, vastly simplifying the installation and operating guarantees thereof.

It must be clarified that for the second case in which the damping device is placed in the upper portion of the door, said damping device is coupled in said upper portion of the door, the actuating element being fitted in the guide of the frame of the door through the pressure of the flanges the same part has in said second alternative.

In relation to the first alternative, and as a result of the damping device not being statically anchored to the guide, it is the actuating element itself which places it in the service position, since once the user has placed the damping device in the guide, the latter begins to close the sliding door, and once the actuating element activates the damping device, it drives the damping device until it runs into a stop and the sliding door softly closes in a damped manner. From then on, the damping device remains in the service position, this position being the correct one since the actuating element itself defines it in the first closure of the sliding door.

Similarly, in relation to the second alternative and as a result of the actuating device not being statically anchored to the upper portion of the guide of the frame of the door, it is the damping device itself which places it in the service position, since once the user has placed the actuator in the guide, the latter begins to close the sliding door, and once the damping device touches the actuator, it drives the door until the actuator runs into a stop and the sliding door softly closes in a damped manner. From then on, the actuator remains in the service position, this position being the correct one since the damping device itself defines it in the first closure of the sliding door.

In this sense, there is a need to point out the possibility of describing the associated assembly method for assembling the damping system for closets with sliding doors in relation to the first alternative, which comprises the following steps:

a) coupling the actuating element to the door;

b) fitting the damping device in the upper guide of the frame of the door through elastic deformation of the respective side flanges of each supporting part; and c) moving the door until the closet is closed completely, such that the damping device slides along the guide driven by the actuating element to the service position.

Therefore, there is a need to again describe the significant advantage with respect to the known state of the art referring to how the damping device does not have to be screwed to the guide of the frame of the closet of the sliding door, as it is fitted in the existing profile in the guide, and it is the actuating element itself which defines the service position of the respective elements of the damping system object of the invention; wherein for clarification, the damping element of the oblong body of the damping device must be preloaded before moving the door until it closes, since the actuating element interacts in this manner with the damping device and the positioning of this damping device is ideal for service.

In the case of implementing the second alternative of placing the main entities, the following steps are described:

a) coupling the damping device to the upper portion of the door;

b) fitting the actuating element in the upper guide of the frame) of the door through elastic deformation of its respective side flanges; and c) moving the door until the closet is closed completely, such that the actuating element moves along the guide and is driven by the damping device to the service position.

The possibility that each supporting part of the damping device in the first alternative embodiment has a rectangular base on which one of the ends of the oblong body is coupled, and said at least one flange is formed on each side of said base is contemplated, said flange having a simple geometry that can adapt perfectly to the profiles of the guides of the frame of the door for being fitted therein; and wherein there are formed on the sides of said base respective flanges which deform elastically with respect to the inner surfaces of the guide of the frame of the door, each supporting part being able to be made of a plastic material or the like.

In order to be able to statically couple the damping device to the guide once it is positioned in the service position, the option in which each supporting part has a plurality of holes configured to allow the passage of fixing means towards the guide of the sliding door is described, the fixing means being able to be screws or similar fixing means.

Similarly, the geometry of the actuating element of said second alternative has a rectangular base on which one of the ends of the oblong body is coupled, and said at least one flange is formed on each side of said base. In order to be able to statically couple the actuating element to the upper guide of the frame of the door once it is positioned in the service position, the preferred option in which the same actuating element has a plurality of holes configured to allow the passage of fixing means towards the upper guide of the frame of the sliding door is described, the fixing means being able to be screws or similar fixing means.

In this sense, and as a continuation of the assembly method for assembling the damping system object of the invention of the first alternative embodiment, the possibility that after step c), the method comprises fixing each supporting part in the upper guide of the frame of the door through screws screwed to the guide and going through the respective holes made on each supporting part or actuating element is contemplated. It must be borne in mind that in the first alternative, the damping device is already placed in the service position and does not require the user to place said device at a specific distance from the frame of the door close to the closure thereof.

Finally, and in relation to how the actuating element is coupled with respect to the door or to the guide of said door, the possibility that said actuating element has a plurality of holes configured to allow the passage of fixing means towards the larger inner surface of the sliding door or to the sides of the guide of the door, to the back of the door or to the upper guide of the frame of the closet is contemplated, these fixing means preferably being screws or the like.

In this sense, and in relation to the first alternative and its assembly method for assembling the damping system object of the invention, the option in which in step a) the actuating element is coupled to the door through screws screwed to the door or the guide thereof and going through the respective holes made on said actuating element is contemplated.

Therefore, the proposed invention allows obtaining a damping system for closets with sliding doors and an associated assembly method that are capable of reducing the closing speed of the sliding door of the closet, preventing impacts of the door itself with the side frame of the closet; furthermore, the system does not require additional tools for installing the damping device, or taking measurements for positioning the damping device for correct operation, since it positions itself during the closure of the door as a result of the actuating element coupled thereto and the drive of said damping device.

DESCRIPTION OF THE DRAWINGS

To complement the description that is being made and for the purpose of aiding to better understand the features of the invention according to a preferred practical embodiment thereof, a series of drawings is attached as an integral part of said description in which the following has been depicted with an illustrative and non-limiting character.

PREFERRED EMBODIMENT OF THE INVENTION

Figure 2:
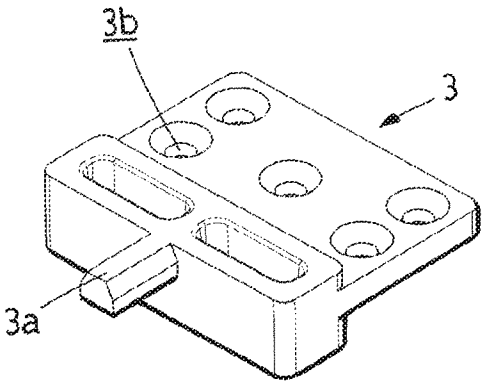
FIG. 2 shows a three-dimensional view of the actuating element of the damping system for closets with sliding doors object of the invention, corresponding to the first alternative.
Figure 4:
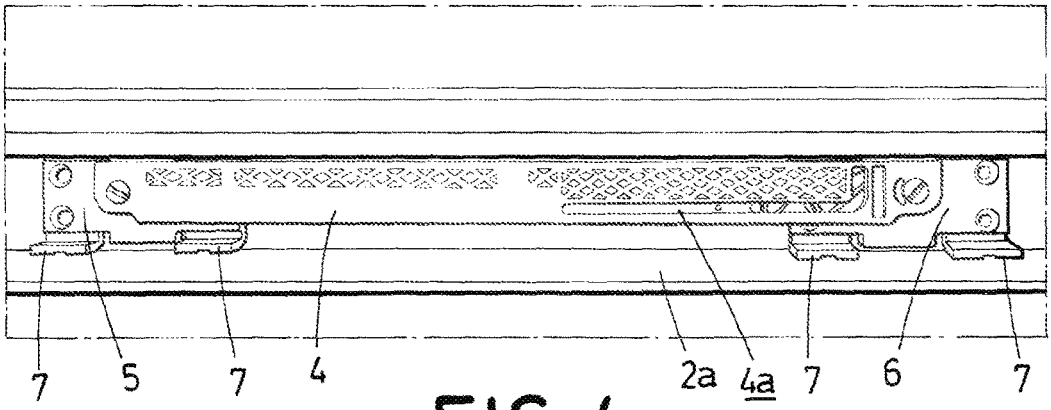
FIG. 4 shows a first three-dimensional view of the damping device fitted in a guide for sliding doors of the closet.
Figure 5:
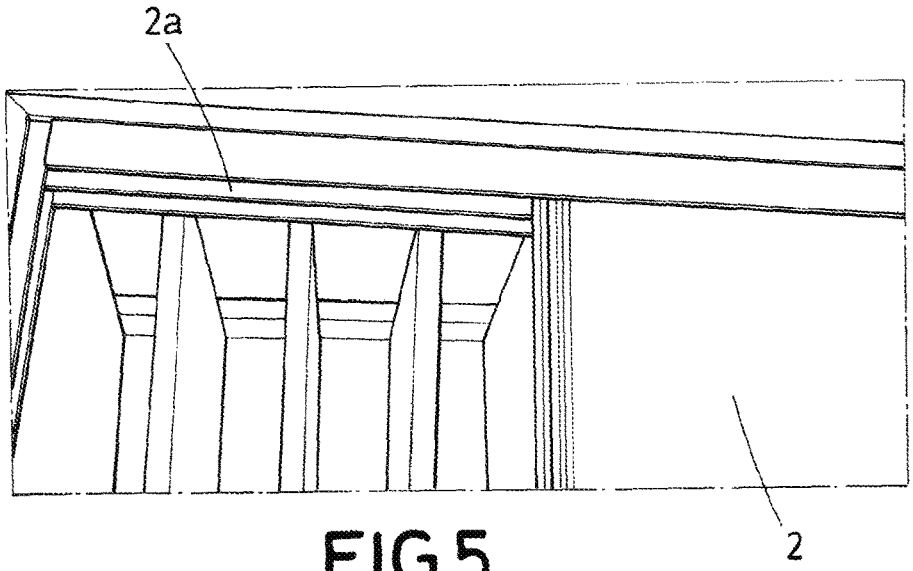
FIG. 5 shows a second three-dimensional view of the guide for sliding doors of the closet, as well as the actual sliding door to be moved.

In view of FIGS. 1 to 5, and taking into account that said drawings depict the first alternative embodiment, it can be seen therein how the damping system for closets with sliding doors (2) object of the invention comprises:

- a damping device (1) coupled to one of the guides (2*a*) of one of the doors (2) of the closet; and
- an actuating element (3) coupled to the door (2), which can be seen in detail in FIG. 2 which shows how said actuating element (3) has a projection (3*a*) configured for coming into contact with the damping device (1) coupled to said door (2) and reducing the closing speed thereof. Furthermore, the actuating element (3) has a plurality of holes (3*b*) configured to allow the passage of fixing screws towards the larger inner surface of the sliding door (2).

The damping device (1) is formed by:

- an oblong body (4) in turn having a damping element, defining a longitudinal direction of the oblong body (4) parallel to the guide (2*a*) of the door (2) of the closet; and
- a pair of respective supporting parts (5, 6) coupled to the ends of said oblong body (4), such that each supporting part (5, 6) has a pair of flanges (7) located respectively on the sides of each supporting part (5, 6) and in the direction parallel to the longitudinal direction of the oblong body (4), and said flanges (7) being configured for coming into contact with the side walls of the guide (2*a*), allowing the damping device (1) to be secured inside the guide (2*a*) as a result of the pressure of said flanges (7) on the side walls of the guide (2*a*) and allowing the said damping device (1) to slide along said guide (2*a*).

Figure 1:
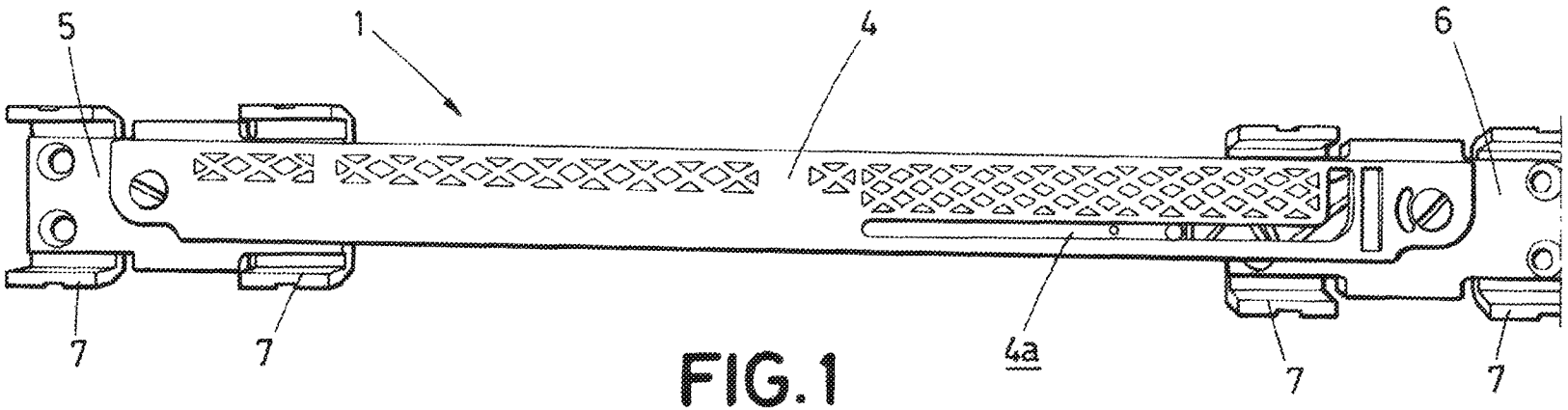
FIG. 1 shows a two-dimensional view of the damping device of the damping system for closets with sliding doors object of the invention.
Figure 3:
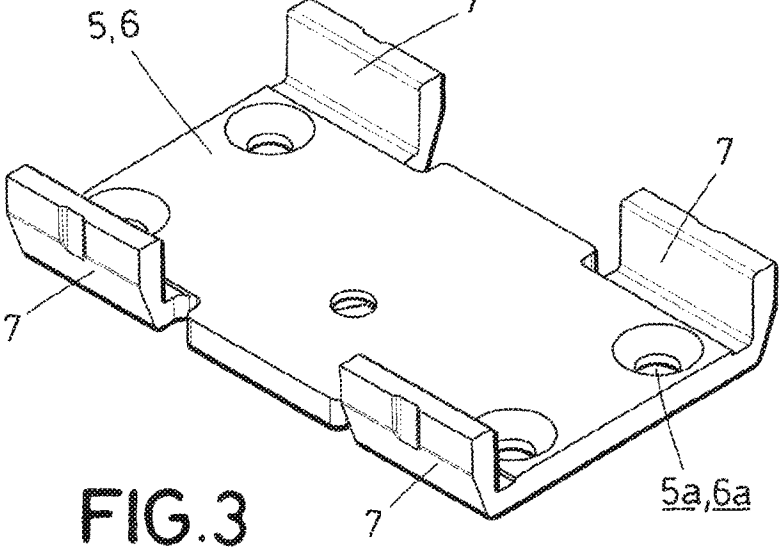
FIG. 3 shows a three-dimensional view of one of the supporting parts of the damping device of the damping system for closets with sliding doors object of the invention, two pairs of flanges being seen located on the sides of the rectangular base of the support itself, corresponding to the first alternative.

As can be seen in detail in FIG. 3, each supporting part (5, 6) has a rectangular base on which one of the ends of the oblong body (4) is coupled, and a pair of flanges (7) is formed on each side of said base by way of bends orthogonal to the larger surfaces of the base of each supporting part (5, 6). Likewise, each supporting part (5, 6) has a plurality of holes (5*a*, 6*a*) configured to allow the passage of fixing screws towards the guide (2*a*) of the sliding door (2).

The oblong body (4) of the damping device (1) has an L-shaped groove (4*a*) on one of the faces in correspondence with the location of said projection (3*a*) of the actuating element (3), and said groove (4*a*) being configured to allow partially housing said projection (3*a*) of the actuating element (3) and activating the damping element housed in said oblong body (4).

The assembly method for assembling the damping system for closets with sliding doors (2) object of the invention comprises the following steps:

a) coupling the actuating element (3) to the door (2);

b) fitting the damping device (1) in the upper guide of the frame (2*a*) of the door (2) through elastic deformation of the respective side flanges (7) of each supporting part (5, 6); and c) moving the door (2) until the closet is closed completely, such that the damping device (1) moves along the guide (2*a*) and is driven by the actuating element (3) to the service position.

Once positioned, the user must fix the damping device with screws to thereby assure a correct operation over time; to that end, and after step c), the method comprises the step associated with fixing each supporting part (5, 6) in the guide (2*a*) of the door (2) through screws screwed to the guide (2*a*) and going through respective holes (5*a*, 6*a*) made on each supporting part (5, 6).

Figure 6:
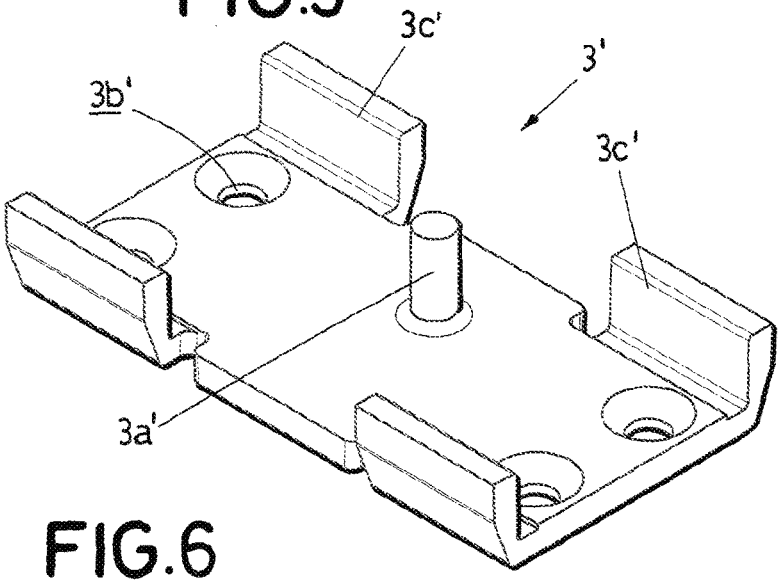
FIG. 6 shows a three-dimensional view of the actuating element of the damping system for closets with sliding doors object of the invention, corresponding to the second alternative.
Figure 7:
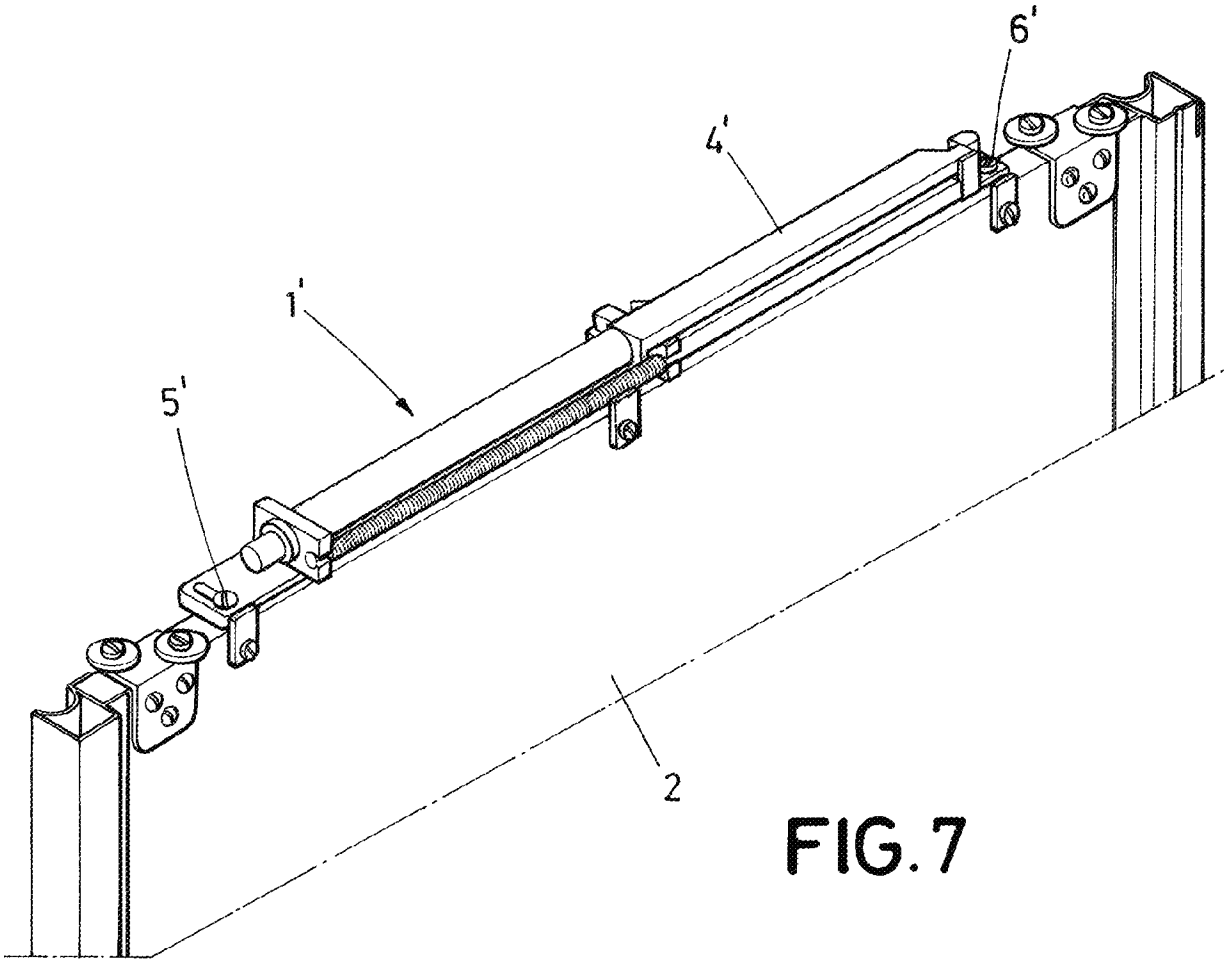
FIG. 7 shows a three-dimensional view of the damping device of the damping system for closets with sliding doors object of the invention, corresponding to the second alternative.

Finally, and in view of FIGS. 6 and 7, and taking into account that FIG. 6 depicts the actuating element (3') of the second alternative embodiment, it can be seen how the actuating element (3') comprises a pair of flanges (3*c'*) located respectively on the sides of said actuating element (3'), which flanges (3*c'*) are configured to allow the actuating element (3') to be secured in the guide (2*a*) (upper portion of the frame) of the door (2) (the closet itself), and to allow said actuating element (3') to slide driven by the damping device (1') during the relative movement between both as a result of the projection (3*a'*) configured for coming into contact with the damping device (1') and reducing the closing speed of the door (2).

In view of FIG. 6, it can be seen how the actuating element (3') is configured for being fitted in the upper guide (2*a*) of the frame of the door (2) as a result of the pressure of the flanges (3*c'*) on the side walls of the guide (2*a*); and in view of FIG. 7, the damping device (1') in this second alternative embodiment is coupled in the upper portion (2*b*) of the door (2).

Likewise, FIG. 7 depicts the damping device (1') coupled to the upper portion (2*b*) of the door (2), and wherein said damping device (1') also has an oblong body (4') and two associated supporting parts (5', 6'), wherein said damping device (1') and the associated oblong body (4') has a groove on one of the faces in correspondence with the location of said projection (3*a'*) of the actuating element (3'), and said groove being configured to allow partially housing said projection (3*a'*) of the actuating element (3') and activating the damping element housed in said oblong body (4').

Additionally, the actuating element (3') has a plurality of holes (3*b'*) configured to allow the passage of fixing means towards the upper guide of the frame (2*a*) of the door (2).

In view of this description and set of drawings, the person skilled in the art will understand that the embodiments of the invention which have been described can be combined in many ways within the object of the invention. The invention has been described according to several preferred embodiments thereof, but for the person skilled in the art it will be obvious that multiple variations can be introduced in said preferred embodiments without exceeding the object of the claimed invention.

The invention claimed is:

1. Damping system for closets with sliding doors (2) comprising:

a damping device (1) and an actuating element (3), wherein said actuating element (3) is coupled to the door (2) and comprises at least one projection (3*a*) configured for coming into contact with the damping device (1); and wherein the damping device (1) is characterized in that it comprises:

an oblong body (4) in turn having a damping element, defining a longitudinal direction of the oblong body (4) parallel to an upper guide of a frame (2*a*) of the door (2) of the closet, wherein the at least one projection (3*a*) is slidably engaged with the oblong body; and a pair of respective supporting parts (5, 6) coupled to the ends of said oblong body (4), such that each supporting part (5, 6) has a pair of flanges (7) located respectively on the sides of each supporting part (5, 6), and in the direction parallel to the longitudinal direction of the oblong body (4), and said flanges (7) being configured to allow the damping device (1) to be movably secured in the upper guide (2*a*) of the closet itself and to allow said damping device (1) to slide driven by the actuating element (3) during the relative movement between the damping device (1) and the actuating element (3).

2. Damping system for closets with sliding doors (2) according to claim 1, characterized in that the actuating element (3) is coupled to the door (2) and the damping device (1) is fitted in the upper guide (2*a*) of the frame of the door (2) as a result of the pressure of the flanges (7) on the side walls of the guide (2*a*).

3. Damping system for closets with sliding doors (2) according to claim 1, characterized in that each supporting part (5, 6) has a rectangular base on which one of the ends of the oblong body (4) is coupled, and said at least one flange (7) is formed on each side of said base.

4. Damping system for closets with sliding doors (2) according to claim 1, characterized in that each supporting part (5, 6) has a plurality of holes (5*a*, 6*a*) configured to allow the passage of fixing means towards the upper guide (2*a*) of the frame of the sliding door (2).

5. Damping system for closets with sliding doors (2) according to claim 1, characterized in that the oblong body (4) has at least one groove (4*a*) on one of the faces in correspondence with the location of said at least one projection (3*a*) of the actuating element (3), and said groove (4*a*) is configured to allow partially housing said projection (3*a*) of the actuating element (3) and activating the damping element housed in said oblong body (4).

6. Damping system for closets with sliding doors (2) according to claim 1, characterized in that the actuating element (3) has a plurality of holes (3*b*, 3*b*') configured to allow the passage of fixing means towards the upper guide (2*a*) of the frame of the door (2).

7. Assembly method for assembling the damping system for closets with sliding doors (2) defined in claim 1, characterized in that it comprises the following steps:

a) coupling the actuating element (3) to the door (2);

b) fitting the damping device (1) in the upper guide (2*a*) of the frame of the door (2) through elastic deformation of the respective side flanges (7) of each supporting part (5, 6); and c) moving the door (2) until the closet is closed completely, such that the damping device (1) moves along the guide (2*a*) and is driven by the actuating element (3) to the service position.

8. Assembly method for assembling the damping system for closets with sliding doors (2) according to claim 7, characterized in that after step c), the method comprises fixing each supporting part (5, 6) in the upper guide (2*a*) of the frame of the door (2) through screws screwed to the guide (2*a*) and going through respective holes (5*a*, 6*a*) made on each supporting part (5, 6).

9. Damping system for closets with sliding doors (2) comprising:

a damping device (1') coupled to the door (2) and an actuating element (3'), wherein said actuating element (3') comprises at least one projection (3*a*'), wherein the at least one projection (3*a*) is slidably engaged with the damping device (1'); and wherein the actuating element (3') is characterized in that it comprises a pair of flanges (3*c*') located respectively on the sides of said actuating element (3'), which flanges (3*c*') are configured to allow the actuating element (3') to be movably secured in an upper guide (2*a*) of a frame of the door (2) of the closet itself and to allow said actuating element (3') to slide driven by the damping device (1') during the relative movement between the damping device (1') and the actuating element (3').

10. Damping system for closets with sliding doors (2) according to claim 9, characterized in that the actuating element (3') is fitted in the upper guide (2*a*) of the frame of the door (2) as a result of the pressure of the flanges (3*c*) on the side walls of the guide (2*a*) and the damping device (1') is coupled in the upper portion (2*b*) of the door (2).

11. Assembly method for assembling the damping system for closets with sliding doors (2) defined in claim 9, characterized in that it comprises the following steps:

a) coupling the damping device (1') to the upper portion (2*b*) of the door (2);

b) fitting the actuating element (3') in the upper guide (2*a*) of the frame of the door (2) through elastic deformation of its respective side flanges (3*c*'); and c) moving the door (2) until the closet is closed completely, such that the actuating element (3') moves along the upper portion of the door (2) and is driven by the damping device (1') to the service position.

12. Assembly method for assembling the damping system for closets with sliding doors (2) according to claim 11, characterized in that after step c), the method comprises fixing the actuating element (3') in the upper guide (2*a*) of the frame of the door (2) through screws screwed to said guide (2*a*) and going through respective holes (3*b*') made on said actuating element (3').

13. Damping system for closets with sliding doors (2) comprising:

a damping device (1) and an actuating element (3), wherein said actuating element (3) is coupled to the door (2) and comprises at least one projection (3*a*) configured for coming into contact with the damping device (1); and wherein the damping device (1) is characterized in that it comprises:

an oblong body (4) in turn having a damping element, defining a longitudinal direction of the oblong body (4) parallel to an upper portion (2*b*) of the door (2) of the closet, wherein the at least one projection (3*a*) is slidably engaged with the oblong body; and a pair of respective supporting parts (5, 6) coupled to the ends of said oblong body (4), such that each supporting part (5, 6) has a pair of flanges (7) located respectively on the sides of each supporting part (5, 6), and in the direction parallel to the longitudinal direction of the oblong body (4), and said flanges (7) being configured to allow the damping device (1) to be movably secured in the upper portion (2*b*) of the closet itself and to allow said damping device (1) to slide driven by the actuating element (3) during the relative movement between the damping device (1) and the actuating element (3).

14. Damping system for closets with sliding doors (2) according to claim 13, characterized in that the actuating element (3) has a plurality of holes (3*b*, 3*b*') configured to allow the passage of fixing means towards the larger inner surface of the sliding door (2).

* * * * *